US009864307B2

(12) United States Patent
Sengoku et al.

(10) Patent No.: US 9,864,307 B2
(45) Date of Patent: Jan. 9, 2018

(54) IMAGE FORMING APPARATUS WITH A CONTROLLER TO SET TRANSFER BIAS

(71) Applicants: Kenji Sengoku, Kanagawa (JP); Hiromi Ogiyama, Tokyo (JP); Hiroyoshi Haga, Kanagawa (JP); Tomokazu Takeuchi, Tokyo (JP); Yasunobu Shimizu, Kanagawa (JP); Junpei Fujita, Kanagawa (JP)

(72) Inventors: Kenji Sengoku, Kanagawa (JP); Hiromi Ogiyama, Tokyo (JP); Hiroyoshi Haga, Kanagawa (JP); Tomokazu Takeuchi, Tokyo (JP); Yasunobu Shimizu, Kanagawa (JP); Junpei Fujita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/076,031

(22) Filed: Mar. 21, 2016

(65) Prior Publication Data

US 2016/0202644 A1 Jul. 14, 2016

Related U.S. Application Data

(63) Continuation of application No. 13/483,536, filed on May 30, 2012, now Pat. No. 9,323,170.

(30) Foreign Application Priority Data

Jun. 28, 2011 (JP) ..... 2011-142861
Mar. 16, 2012 (JP) ..... 2012-060062

(51) Int. Cl.
*G03G 15/16* (2006.01)
*G03G 15/02* (2006.01)
*G03G 15/01* (2006.01)

(52) U.S. Cl.
CPC ..... *G03G 15/1665* (2013.01); *G03G 15/0189* (2013.01); *G03G 15/0266* (2013.01); *G03G 2215/0129* (2013.01)

(58) Field of Classification Search
CPC ..... G03G 15/0189; G03G 15/1665
(Continued)

(56) References Cited

U.S. PATENT DOCUMENTS 4,528,937 A 7/1985 Kanno et al.
4,851,874 A 7/1989 Ogiyama
(Continued)

FOREIGN PATENT DOCUMENTS

JP 63029767 A 2/1988
JP 03284778 A 12/1991
(Continued)

OTHER PUBLICATIONS

Translation jp2010-281907.

*Primary Examiner* — Quana M Grainger
(74) *Attorney, Agent, or Firm* — Oblon, McClelland, Maier & Neustadt, L.L.P.

(57) ABSTRACT

An image forming apparatus includes an image bearing member to bear a toner image charged with a predetermined polarity, and a power source to apply a bias to a transfer portion to transfer the toner image from the image bearing member to a recording medium, a polarity of the bias being changed alternately. The toner image formed with toner of a plurality of colors is transferred in a color mode and the toner image formed with toner of a single color is transferred in a monochrome mode. The bias includes a peak voltage with a polarity that returns toner from the recording medium to the image bearing member. An absolute value of the peak voltage in the color mode is equal to or greater than an absolute value of the peak voltage in the monochrome mode.

22 Claims, 4 Drawing Sheets

(58) Field of Classification Search
USPC ..... 399/66
See application file for complete search history.

(56) References Cited

U.S. PATENT DOCUMENTS

| | | | | |
|---|---|---|---|---|
| 5,029,840 | A | 7/1991 | Haga et al. | |
| 5,483,330 | A | 1/1996 | Ogiyama et al. | |
| 5,991,570 | A | 11/1999 | Haga et al. | |
| 6,405,002 | B2 | 6/2002 | Ogiyama et al. | |
| 6,618,565 | B2 | 9/2003 | Tamiya et al. | |
| 6,697,595 | B2 | 2/2004 | Kawagoe et al. | |
| 6,741,821 | B2 | 5/2004 | Sugino et al. | |
| 6,785,500 | B2 | 8/2004 | Takahashi et al. | |
| 6,829,450 | B2 | 12/2004 | Tamiya et al. | |
| 6,901,234 | B2 | 5/2005 | Ogiyama et al. | |
| 7,003,238 | B2 | 2/2006 | Yoshida et al. | |
| 7,203,433 | B2 | 4/2007 | Kato et al. | |
| 7,277,657 | B2 | 10/2007 | Uchida et al. | |
| 7,280,792 | B2 | 10/2007 | Sawai et al. | |
| 7,346,287 | B2 | 3/2008 | Ogiyama et al. | |
| 7,610,004 | B2 | 10/2009 | Kato et al. | |
| 7,773,928 | B2 | 8/2010 | Ogiyama et al. | |
| 8,135,319 | B2 | 3/2012 | Fujita | |
| 8,923,716 | B2 * | 12/2014 | Nakamura ..... | G03G 15/1605 399/121 |
| 2003/0118359 | A1 | 6/2003 | Ogiyama et al. | |
| 2008/0232867 | A1 | 9/2008 | Minbu et al. | |
| 2009/0103940 | A1 | 4/2009 | Tomiie | |
| 2010/0040386 | A1 | 2/2010 | Mizutani et al. | |
| 2010/0067952 | A1 | 3/2010 | Fujita et al. | |
| 2010/0080631 | A1 | 4/2010 | Ogiyama et al. | |
| 2010/0098446 | A1 | 4/2010 | Ishikawa et al. | |
| 2010/0142985 | A1 | 6/2010 | Minbe et al. | |
| 2010/0221029 | A1 | 9/2010 | Minbu et al. | |
| 2010/0329707 | A1 * | 12/2010 | Yamada ..... | G03G 15/161 399/44 |
| 2011/0064487 | A1 | 3/2011 | Ichihashi et al. | |
| 2011/0158690 | A1 | 6/2011 | Mimbu et al. | |
| 2011/0181116 | A1 | 7/2011 | Takeuchi et al. | |
| 2011/0206399 | A1 | 8/2011 | Fujita et al. | |
| 2011/0286759 | A1 | 11/2011 | Ichihashi et al. | |
| 2011/0293312 | A1 | 12/2011 | Mimbu et al. | |
| 2012/0008991 | A1 | 1/2012 | Shimizu | |
| 2012/0045237 | A1 | 2/2012 | Aoki et al. | |

FOREIGN PATENT DOCUMENTS

| | | | | |
|---|---|---|---|---|
| JP | 09319219 | A | * | 12/1997 |
| JP | 10319746 | A | * | 12/1998 |
| JP | 2004-117920 | | | 4/2004 |
| JP | 2007-57902 | A | | 3/2007 |
| JP | 2010-281907 | | | 12/2010 |
| JP | 2011-13241 | A | | 1/2011 |

* cited by examiner

IMAGE FORMING APPARATUS WITH A CONTROLLER TO SET TRANSFER BIAS

CROSS-REFERENCE TO RELATED APPLICATIONS

This patent application is a continuation application of U.S. patent application Ser. No. 13/483,536, filed on May 30, 2012, and is based on and claims priority pursuant to 35 U.S.C. §119 from Japanese Patent Application Nos. 2011-142861, filed on Jun. 28, 2011, and 2012-060062, filed on Mar. 16, 2012, both in the Japan Patent Office. The entire contents of each of the above applications are hereby incorporated herein by reference in entirety.

BACKGROUND OF THE INVENTION

Field of the Invention

Exemplary aspects of the present invention generally relate to an electrophotographic image forming apparatus, such as a copier, a facsimile machine, a printer, or a multi-functional system including a combination thereof.

Description of the Related Art

Related-art image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image bearing member (which may, for example, be a photoconductive drum); an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

In known image forming apparatuses, a transfer method known as a direct current (DC) transfer method, in which a direct current bias is applied to a transfer device, is widely employed to transfer a toner image onto a recording medium.

In recent years, there is also known an alternating current (AC) transfer method in which a superimposed bias (also known as an AC bias) is applied to the transfer device. In the AC transfer method, the superimposed bias is composed of an alternating current (AC) voltage superimposed on a DC voltage. It is to be noted that thereafter, the transfer method in which the superimposed bias is used as a transfer bias is referred to as an AC transfer. The AC transfer method is more advantageous than the DC transfer method for a recording medium having a coarse surface. It is known that the AC transfer method can enhance transferability and prevent a disturbance of toner image such as dropouts.

Although advantageous and generally effective for its intended purpose, in the AC transfer method, toner may not be transferred well if the same transfer bias used in a monochrome mode for forming a monochrome image is applied in a color mode for forming a multicolor or full-color image.

In the known DC transfer method, the level of DC voltage supplied as a transfer bias is changed when forming a color image (in the color mode), such as JP-2004-177920-A. In this approach, in order to prevent improper transfer of toner derived from a difference in the amount of toner in the toner image, a transfer voltage for forming a color image is configured greater than a transfer voltage for forming a monochrome image.

However, the transferability does not increase proportional to the transfer voltage in the AC transfer method. More specifically, simply increasing the transfer voltage does not transfer toner well onto a recording medium for a color image that contains a large amount of toner.

In view of the above, there is thus an unsolved need for an image forming apparatus capable of maintaining good transferability regardless of color imaging or monochrome imaging.

BRIEF SUMMARY OF THE INVENTION

In view of the foregoing, in an aspect of this disclosure, there is provided a novel image forming apparatus including an image bearing member, a transfer device, a transfer bias power source, and a controller. The image bearing member bears a toner image on a surface thereof. The transfer device disposed opposite the image bearing member transfers the toner image from the image bearing member onto a recording medium. The transfer bias power source applies, between the image bearing member and the transfer device, a superimposed transfer bias in which a direct current (DC) component and an alternative current (AC) component are superimposed to transfer the toner image borne on the image bearing member to the recording medium. The controller changes the DC component and the AC component of the superimposed bias that the transfer bias power source applies. The controller changes the DC component and the AC component of the superimposed transfer bias in a color mode from that in a monochrome mode, to secure a return electric field in the superimposed transfer bias by which the toner is returned from the recording medium to the image bearing member. In the color mode, an image is formed with a plurality of toners. In the monochrome mode, an image is formed with a toner of a single color.

In another aspect of this disclosure there is provided a method for forming an image. The method includes forming a toner image on a surface of an image bearing member; transferring the toner image from the image bearing member onto a recording medium; applying, between the image bearing member and a transfer device, a superimposed transfer bias in which a direct current (DC) component and an alternative current (AC) component are superimposed to transfer the toner image borne on the image bearing member to the recording medium; and changing levels of the DC component and the AC component of the superimposed bias applied by the applying. The changing step includes changing the levels of the DC component and the AC component of the superimposed bias in a color mode from that in a monochrome mode, to secure a return electric field in the superimposed transfer bias by which the toner is returned from the recording medium to the image bearing member. In the color mode an image is formed with a plurality of toners, and in the monochrome mode an image is formed with a toner of a single color.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF DISCLOSED EMBODIMENTS

Figure 1:
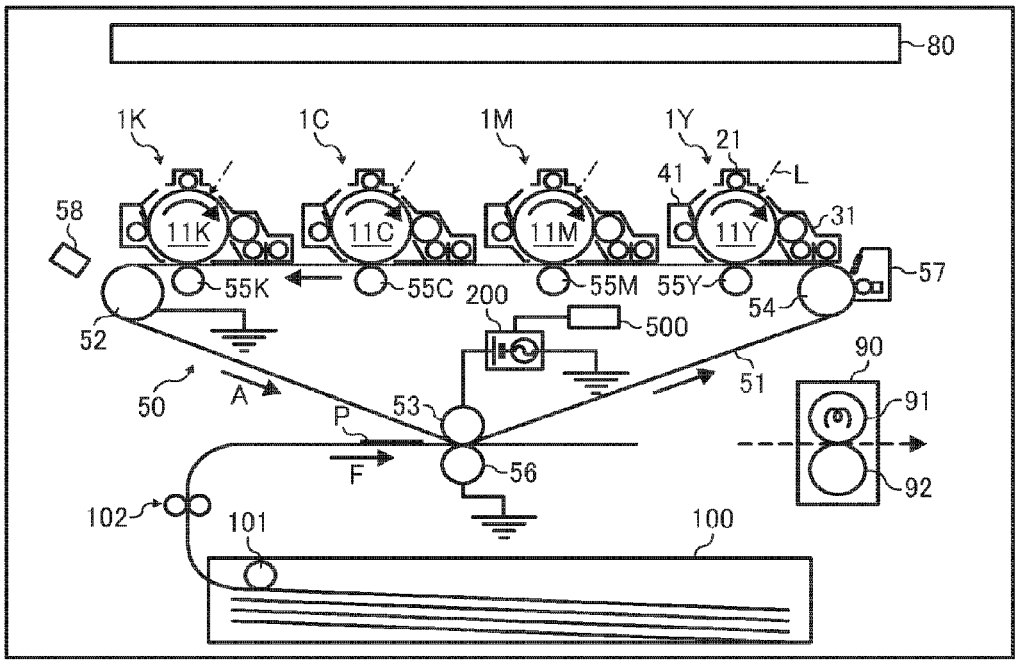
FIG. 1 is a cross-sectional diagram schematically illustrating an example of an image forming apparatus according to an illustrative embodiment of the present invention.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially with reference to FIG. 1, a description is provided of an image forming apparatus according to an illustrative embodiment of the present invention.

FIG. 1 is a schematic diagram illustrating a color printer as an example of the image forming apparatus employing an intermediate transfer method in which a toner image is indirectly transferred onto a recording medium via an intermediate transfer member according to an illustrative embodiment of the present invention. In FIG. 1, the image forming apparatus includes four image forming units 1Y, 1M, 1C, and 1K (which may be collectively referred to as image forming units 1), an optical writing unit 80, a transfer unit 50 including an intermediate transfer belt 51, a fixing device 90, and so forth. Substantially above the intermediate transfer belt 51, the image forming units 1Y, 1M, 1C, and 1K, one for each of the colors yellow, magenta, cyan, and black are arranged in tandem in the direction of movement of the intermediate transfer belt 51, thereby constituting a tandem imaging station.

It is to be noted that suffixes Y, M, C, and K denote the colors yellow, magenta, cyan, and black, respectively. To simplify the description, the suffixes Y, M, C, and K indicating colors are omitted herein unless otherwise specified.

Figure 2:
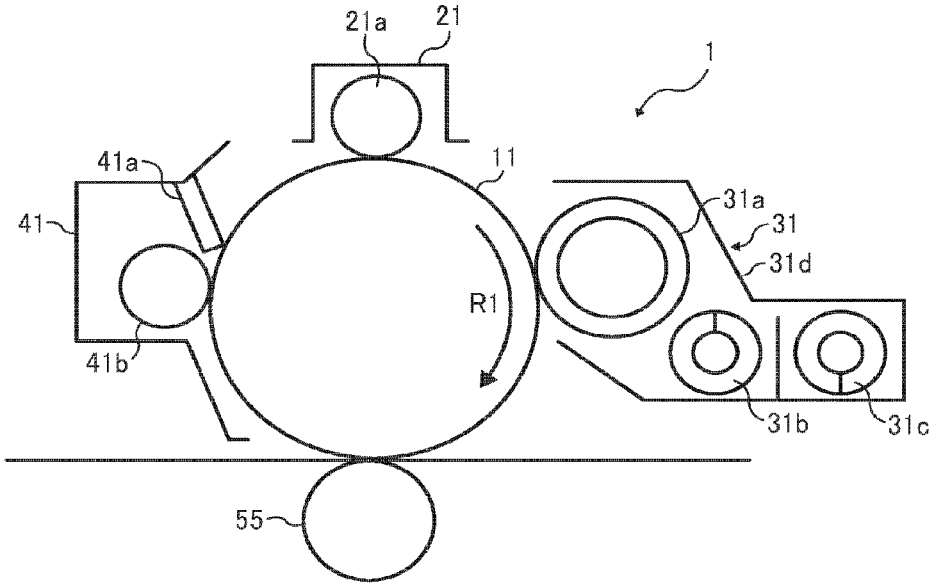
FIG. 2 is a cross-sectional diagram schematically illustrating an image forming unit as a representative example of image forming units employed in the image forming apparatus of FIG. 1 according to an illustrative embodiment of the present invention.

With reference to FIG. 2, a description is provided of the image forming units 1. The image forming units 1Y, 1M, 1C, and 1K all have the same configuration as all the others, differing only in the color of toner employed. Thus, a description is provided of one of the image forming units 1, and the suffix indicating the color is omitted. FIG. 2 is a schematic diagram illustrating the image forming unit 1. As illustrated in FIG. 2, the image forming unit 1 includes a drum-shaped photosensitive member 11, a charging device 21, a developing device 31, a primary transfer roller 55, a cleaning device 41, and so forth.

The charging device 21 charges the surface of the photosensitive drum 11 by using a charging roller 21*a*. The developing device 31 develops a latent image formed on the photosensitive drum 11 with a respective color of toner to form a visible image known as a toner image. The primary transfer roller 55 serving as a primary transfer member transfers the toner image from the photosensitive drum 11 to the intermediate transfer belt 51. The cleaning device 41 cleans the surface of the photosensitive drum 11 after primary transfer. According to the illustrative embodiment, the image forming units 1Y, 1M, 1C, and 1K are detachably attachable relative to the image forming apparatus main body.

The photosensitive drum 11 is constituted of a drum-shaped base on which an organic photosensitive layer is disposed. The external diameter of the photosensitive drum is approximately 60 mm. The photosensitive drum 11 is rotated in a clockwise direction indicated by an arrow R1 by a driving device, not illustrated. The charging roller 21*a* of the charging device 21 is supplied with a charging bias. The charging roller 21*a* contacts or is disposed close to the photosensitive drum 11 to generate an electrical discharge therebetween, thereby charging uniformly the surface of the photosensitive drum 11.

According to the present illustrative embodiment, the photosensitive drum 11 is uniformly charged with a negative polarity which is the same polarity of normal charge on toner. As the charging bias, an alternating current (AC) voltage superimposed on a direct current (DC) voltage is employed. According to the present illustrative embodiment, the photoconductive drum 11 is charged by the charging roller 21*a* contacting or disposed near the photoconductive drum 11. Alternatively, a charger such as a corona charger may be employed.

The developing device 31 includes a developing sleeve 31*a*, and paddles 31*b* and 31*c* inside a developer container 31*d*. In the developer container 31*d*, a two-component developing agent consisting of toner particles and carriers is stored. The developing sleeve 31*a* serves as a developer bearing member and faces the photoconductive drum 11 via an opening of the developer container 31*d*. The paddles 31*b* and 31*c* mix the developing agent and deliver the developing agent to the developing sleeve 31*a*. According to the present illustrative embodiment, the two-component developing agent is used. Alternatively, a single-component developing agent may be used.

The cleaning device 41 includes a cleaning blade 41*a* and a cleaning brush 41*b* to clean the surface of the photosensitive drum 11. The cleaning blade 41*a* of the cleaning device 41 contacts the surface of the photosensitive drum 11 at a certain angle such that the leading edge of the cleaning blade 41*a* faces counter to the direction of rotation of the photosensitive drum 11. The cleaning brush 41*b* rotates in the direction opposite to the direction of rotation of the photosensitive drum 11 while contacting the photosensitive drum 11.

Referring back to FIG. 1, a description is provided of the optical writing unit 80. The optical writing unit 80 for writing a latent image on each of photosensitive drums 11Y, 11M, 11C, and 11K (which may be referred to collectively as photosensitive drums 11) is disposed above the image forming units 1Y, 1M, 1C, and 1K. Based on image information received from an external device such as a personal computer (PC), the optical writing unit 80 illuminates the photosensitive drum 11 with a light beam projected from a laser diode of the optical writing unit 80. Accordingly, the electrostatic latent images of yellow, magenta, cyan, and black are formed on the photosensitive drums 11Y, 11M, 11C, and 11K, respectively. More specifically, the potential of the portion of the uniformly-charged surface of the photosensitive drums 11 illuminated with the light beam is attenuated. The potential of the illuminated portion of the photosensitive drum 11 with the light beam is less than the potential of the other area, that is, a background portion (no-image portion), thereby forming an electrostatic latent image on the photosensitive drum 11.

Although not illustrated, the optical writing unit 80 includes a polygon mirror, a plurality of optical lenses, and mirrors. The light beam projected from the laser diode serving as a light source is deflected in a main scanning direction by the polygon mirror rotated by a polygon motor. The deflected light, then, strikes the optical lenses and mirrors, thereby scanning the photosensitive drums 11. The optical writing unit 80 may employ a light source using an LED array including a plurality of LEDs that projects light.

Still referring to FIG. 1, a description is provided of the transfer unit 50. The transfer unit 50 is disposed below the image forming units 1Y, 1M, 1C, and 1K. The transfer unit 50 includes the intermediate transfer belt 51 serving as an image bearing member formed into an endless loop and entrained about a plurality of rollers, thereby rotating endlessly in the counterclockwise direction indicated by arrow A. The transfer unit 50 also includes a driving roller 52, a secondary transfer roller 53, a cleaning backup roller 54, four primary transfer rollers 55Y, 55M, 55C, and 55K (which may be referred to collectively as primary transfer rollers 55), a nip forming roller 56, a belt cleaning device 57, an electric potential detector 58, and so forth. The primary transfer rollers 55Y, 55M, 55C, and 55K is disposed opposite the photosensitive drums 11Y, 1M, 11C, and 11K, respectively, via the intermediate transfer belt 51.

It is to be noted the suffixes Y, M, C, and K indicating colors are omitted, unless otherwise specified.

The intermediate transfer belt 51 is entrained around and stretched taut between the driving roller 52, the secondary transfer roller 53, the cleaning backup roller 54, and the primary transfer rollers 55, all disposed inside the loop formed by the intermediate transfer belt 51. The driving roller 52 is rotated by a driving device (not illustrated), enabling the intermediate transfer belt 51 to move in the direction of arrow A.

The intermediate transfer belt 51 is made of resin such as polyimide resin in which carbon is dispersed and has a thickness in a range of from approximately 20 μm to 200 μm, preferably, approximately 60 μm. The surface resistivity thereof is in a range of from approximately 9.0 to 13.0 [Log Ω/□], preferably, approximately 10.0 to 12.0 [Log Ω/□]. The surface resistivity is measured by using an HRS probe with an applied voltage of 500V. The surface resistivity is calculated after 10 seconds elapsed. The volume resistivity thereof is in a range of from approximately 6.0 to 13.0 [Log Ω·cm], preferably, approximately 7.5 to 12.5 [Log Ω·cm], and more preferably, approximately 9 [Log Ω·cm]. The volume resistivity is measured by using the HRS probe with an applied voltage of 100V. The volume resistivity is calculated after 10 seconds elapsed.

The intermediate transfer belt 51 is interposed between the photosensitive drums 11Y, 11M, 11C, and 11K, and the primary transfer rollers 55. Accordingly, primary transfer nips are formed between the front surface (image bearing surface) of the intermediate transfer belt 51 and the photosensitive drums 11Y, 11M, 11C, and 11K contacting the intermediate transfer belt 51. The primary transfer rollers 55 are applied with a primary bias by a transfer bias power source, thereby generating a transfer electric field between the toner images on the photosensitive drums 11 and the primary transfer rollers 55. Accordingly, the toner images are transferred primarily from the photosensitive drums 11 onto the intermediate transfer belt 51 by the transfer electric field and a nip pressure at the primary transfer nip. More specifically, the toner images of yellow, magenta, cyan, and black are transferred onto the intermediate transfer belt 51 so that they are superimposed atop the other, thereby forming a composite toner image on the intermediate transfer belt 51.

In the case of monochrome imaging, a support plate supporting the primary transfer rollers 55Y, 55M, and 55C of the transfer unit 50 is moved to separate the primary transfer rollers 55Y, 55M, and 55C from the photosensitive drums 11Y, 11M, and 11C. Accordingly, the front surface of the intermediate transfer belt 51, that is, the image bearing surface, is separated from the photosensitive drums 11Y, 11M, and 11C so that the intermediate transfer belt 51 contacts only the photosensitive drum 11K. In this state, only the image forming unit 1K is activated to form a toner image of black on the photosensitive drum 11K.

Each of the primary transfer rollers 55 is constituted of an elastic roller including a metal cored bar on which a conductive sponge layer is provided. The external diameter of the primary transfer roller 55 is approximately 16 mm, and the diameter of the metal cored bar is approximately 10 mm. A resistance R of the sponge layer of the primary transfer roller 55 is obtained using a rotation measurement method in which a weight of 5 [N] is applied on one side and a bias of 1 [kV] is applied to a shaft of the transfer roller for one minute while the roller makes one rotation. An average of the measured resistance is obtained as a volume resistance. Based on Ohm's law (R=V/I), where R is a resistance, V is a voltage, I is a current, the resistance R of the sponge layer of the roller is calculated. Accordingly, the resistance R of the sponge layer of the primary transfer roller 55 is in a range of from 1e6Ω to 1e9Ω, preferably, approximately 3e7Ω.

A primary transfer bias is applied to the primary transfer rollers 55 with constant current control. According to the illustrative embodiment, a roller-type transfer device (here, the primary transfer roller 55) is used as a primary transfer device. Alternatively, a transfer charger or a brush-type transfer device may be employed as a primary transfer device.

As illustrated in FIG. 1, the nip forming roller 56 of the transfer unit 50 is disposed outside the loop formed by the intermediate transfer belt 51, opposite the secondary transfer roller 53 which is disposed inside the loop. The intermediate transfer belt 51 is interposed between the secondary transfer roller 53 and the nip forming roller 56. Accordingly, a secondary transfer nip is formed between the peripheral surface or the image bearing surface of the intermediate transfer belt 51 and the nip forming roller 56 contacting the surface of the intermediate transfer belt 51. The nip forming roller 56 is grounded. A secondary transfer bias is applied to the secondary transfer roller 53 by a secondary transfer bias power source 200.

With this configuration, a secondary transfer electric field is formed between the secondary transfer roller 53 and the nip forming roller 56 so that the toner moves electrostatically from the secondary transfer roller side to the nip forming roller side.

As illustrated in FIG. 1, a sheet cassette 100 storing a stack of recording media sheets P is disposed below the transfer unit 500. The sheet cassette 100 is equipped with a sheet feed roller 101 to contact a top sheet of the stack of recording media sheets P. As the sheet feed roller 101 is rotated at a predetermined speed, the sheet feed roller 101 picks up the top sheet and sends it to a sheet passage.

Substantially at the end of the sheet passage, a pair of registration rollers 102 is disposed. The pair of the registration rollers 102 stops rotating temporarily as soon as the recording medium P delivered from the sheet cassette 100 is interposed therebetween. The pair of registration rollers 102 starts to rotate again to feed the recording medium P to the secondary transfer nip in appropriate timing such that the recording medium P is aligned with a composite or monochrome toner image formed on the intermediate transfer belt 51 in the secondary transfer nip.

In the secondary transfer nip, the recording medium P tightly contacts the composite or monochrome toner image on the intermediate transfer belt 51, and the composite or monochrome toner image is transferred secondarily onto the recording medium P by the secondary transfer electric field and the nip pressure applied thereto. The recording medium P, on which the composite or monochrome toner image is transferred, passes through the secondary transfer nip and separates from the nip forming roller 56 and the intermediate transfer belt 51 due to the elasticity of the recording medium, also known as self stripping.

The secondary transfer roller 53 is constituted of a metal cored bar made of metal such as stainless steel and aluminum on which a resistance layer is laminated. Specific preferred materials suitable for the resistance layer include, but are not limited to, polycarbonate, fluorine-based rubber, silicon rubber, and the like in which conductive particles such as carbon and metal complex are dispersed, or rubbers such as nitrile rubber (NBR) and Ethylene Propylene Diene Monomer (EPDM), rubber of NBR/ECO copolymer, and semiconductive rubber such as polyurethane. Similar to the primary transfer roller 55, the volume resistance of the secondary transfer roller 53 is measured using the rotation measurement method. The volume resistance thereof is in a range of from 6.0 to 8.0 [Log Ω], preferably in a range of from 7.0 to 8.0 [Log Ω]. The resistance layer may be a foam-type having the hardness in a range of from 20 degrees and 50 degrees or a rubber-type having the hardness in a range of from 30 degrees and 60 degrees.

Since the secondary transfer roller 53 contacts the nip forming roller 56 via the intermediate transfer belt 51, the sponge-type layer is preferred because it reliably contacts the nip forming roller 56 via the intermediate transfer belt 51 even with a low contact pressure. With a large contact pressure of the secondary transfer roller 53 and the intermediate transfer belt 51 image defects such as toner dropouts can be prevented. Toner dropouts are a partial toner transfer failure in character images or thin-line images.

The nip forming roller 56 (a counter roller) is constituted of a metal cored bar made of metal such as stainless steel and aluminum, and a resistance layer and a surface layer made of conductive rubber or the like disposed on the metal cored bar. According to the present illustrative embodiment, the external diameter of the nip forming roller 56 is approximately 20 mm, and the diameter of the metal cored bar is approximately 16 mm.

The resistant layer is made of rubber of NBR/ECO copolymer having the hardness in the range of from 40 to 60 degrees according to JIS-A. The surface layer is made of fluorinated urethane elastomer. The thickness thereof is preferably in the range of from 8 to 24 μm. This is because the surface layer of the roller is generally formed during coating process, and if the thickness of the surface layer is less than or equal to 8 μm, the effect of uneven resistance due to uneven coating is significant. As a result, leak may occur at a place with low resistance. Furthermore, the surface of the roller may wrinkle, causing cracks in the surface layer.

By contrast, if the thickness of the surface layer is 24 μm or more, the resistance becomes high. In a case in which the volume resistivity is high, the voltage may rise and exceed an allowable range of voltage change of the constant current power source when the constant current is supplied to the metal cored bar of the secondary transfer roller 53. As a result, the current may drop below the target value. In a case in which the allowable range of voltage change is high enough, the voltage of a high-voltage path from the constant current power source to the metal cored bar of the secondary transfer roller and/or the metal cored bar of the secondary transfer roller may become high, causing the leak easily.

If the thickness of the surface layer of the nip forming roller 56 is 24 μm or more, the hardness becomes high, thereby hindering the nip forming roller 56 from closely contacting the recording medium P and the intermediate transfer belt 51. The surface resistance of the nip forming roller 56 is equal to or greater than $10^{6.5}\Omega$, and the volume resistance thereof is in a range of from 6.0 to 12.0 Log Ω. Preferably, the volume resistance of the nip forming roller 56 when using a metal roller such as SUS is 4.0 Log Ω. The volume resistance is measured using the rotation measurement method as described above.

The electric potential detector 58 is disposed outside the loop formed by the intermediate transfer belt 51, opposite the driving roller 52 which is grounded. More specifically, the electric potential detector 58 faces a portion of the intermediate transfer belt 51 entrained around the driving roller 52 with a gap of approximately 4 mm. The surface potential of the toner image primarily transferred onto the intermediate transfer belt 51 is measured when the toner image comes to the position opposite the electric potential detector 58. According to the present embodiment, a surface potential sensor EFS-22D manufactured by TDK Corp. is used as the electric potential detector 58.

On the right side of the secondary transfer nip between the secondary transfer roller 53 and the intermediate transfer belt 51, the fixing device 90 is disposed. The fixing device 90 includes a fixing roller 91 and a pressing roller 92. The fixing roller 91 includes a heat source such as a halogen lamp inside thereof. While rotating, the pressing roller 92 pressingly contacts the fixing roller 91, thereby forming a heated area called a fixing nip therebetween. The recording medium P bearing an unfixed toner image on the surface thereof is delivered to the fixing device 90 and interposed between the fixing roller 91 and the pressing roller 92 in the fixing device 90. Under heat and pressure in the fixing nip, the toner adhered to the toner image is softened and affixed permanently to the recording medium P. Subsequently, the recording medium P is discharged outside the image forming apparatus from the fixing device 90 along a sheet passage after fixing process.

According to the present illustrative embodiment, the secondary transfer bias power source 200 serving as a secondary transfer bias output device includes a direct current power source and an alternating current power source, and can output a superimposed bias as the secondary transfer bias. The superimposed bias is composed of an alternating current voltage superimposed on a direct current voltage. An output terminal of the secondary transfer bias power source 200 is connected to the metal cored bar of the secondary transfer roller 53.

The level of the electric potential of the metal cored bar of the secondary transfer roller 53 is similar to or the same level as the output voltage of the secondary transfer bias power source 200. Furthermore, the metal cored bar of the nip forming roller 56 is grounded. In this case, using toner having a negative charge polarity, a DC voltage having the same negative polarity as the toner is used so that the time-averaged potential of the superimposed bias has the same polarity as the toner, that is, the negative polarity. According to the present embodiment, an AC voltage has a zero-crossing waveform crossing 0V (zero volts).

According to the illustrative embodiment, the nip forming roller 56 is grounded while the superimposed bias is applied to the secondary transfer roller 53. Alternatively, the secondary transfer roller 53 may be grounded while the superimposed bias is applied to the nip forming roller 56. In a case in which the secondary transfer roller 53 is grounded and the nip forming roller 56 is supplied with the superimposed bias, a DC voltage having the positive polarity which is an opposite polarity to the polarity of toner is used, and the time-averaged potential of the superimposed bias has the positive polarity that is a polarity opposite to the polarity of the toner. The AC voltage has the zero-crossing waveform.

Still alternatively, a DC voltage may be supplied to one of the secondary transfer roller 53 and the nip forming roller 56 while supplying an AC voltage to the other roller. In such a case, when supplying the DC voltage to the secondary transfer roller 53, the DC voltage having the negative polarity same as the toner is used. When supplying the DC voltage to the nip forming roller 56, the DC voltage having the positive polarity which is a polarity opposite to the toner is used. The AC voltage has the zero-crossing waveform.

Alternatively, toner having the positive charge polarity may also be used. In this case, the polarity of the DC voltage is opposite to the polarity described above. In this case, the alternating current voltage has the zero-crossing waveform.

According to the present embodiment, as the AC voltage, an AC voltage having a sinusoidal waveform is used. Alternatively, an AC voltage having a rectangular waveform may be used.

Figure 3:
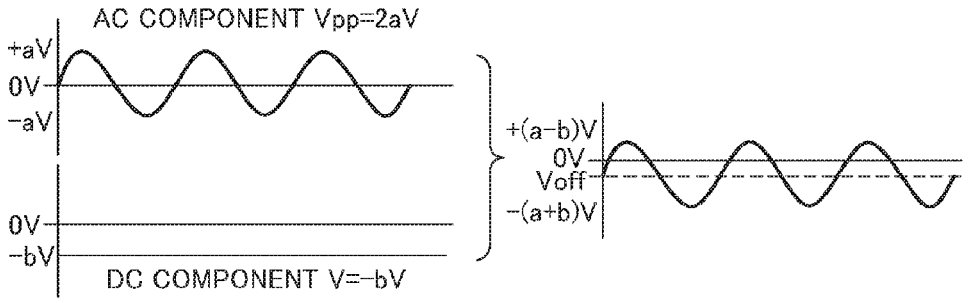
FIG. 3 is a waveform chart showing an example of a waveform of a superimposed bias serving as a secondary transfer bias.

With reference to FIG. 3, a description is provided of the secondary transfer bias using the superimposed bias. FIG. 3 is a waveform chart showing an example of a waveform of a superimposed bias serving as the secondary bias output from the secondary transfer bias power source 200. Here, a description is provided of a case in which the superimposed bias serving as a secondary transfer bias is supplied to the secondary transfer roller 53.

It is to be noted that in general, a potential difference is treated as an absolute value. However, in this specification, the potential difference is treated as a value with polarity. More specifically, a value obtained by subtracting the potential of the metal cored bar of the nip forming roller 56 from the potential of the metal cored bar of the secondary transfer roller 53 is considered as the potential difference. Using toner having the negative polarity as in the illustrative embodiment, when the polarity of the time-averaged value of the potential difference becomes negative, the potential of the nip forming roller 56 is increased beyond the potential of the secondary transfer roller 53 on the opposite polarity side to the polarity of charge on toner (the positive side in the present embodiment). Accordingly, the toner is electrostatically moved from the secondary transfer roller side to the nip forming roller side.

The left side of FIG. 3 illustrates separately the AC component and the DC component of the secondary transfer bias. In the present illustrative embodiment, the AC component having a sinusoidal waveform is used and comprises a positive peak of +aV and a negative peak of −aV. Thus, a peak-to-peak voltage Vpp of the AC component is 2 aV. The DC component of the voltage is −bV.

Figure 4:
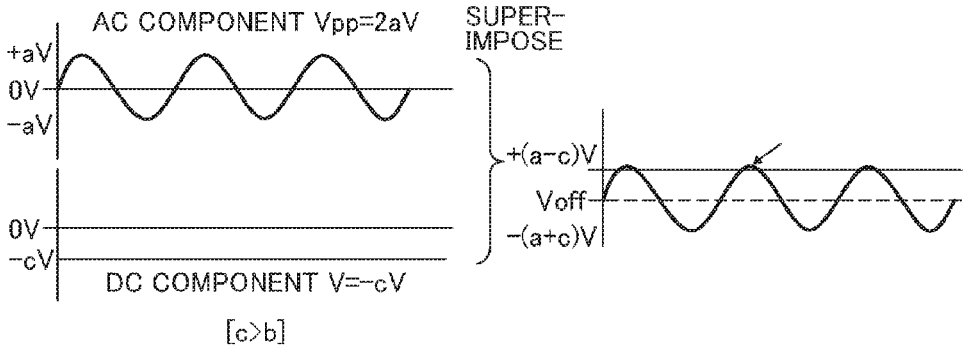
FIG. 4 is a waveform chart showing an example of a waveform of a bias that transfers toner poorly for a color image.

The right side of FIG. 3 illustrates the AC component and the DC component being superimposed. In FIG. 4, an offset voltage Voff has the same level as the DC component of the superimposed bias. According to the illustrative embodiment as described above, the superimposed voltage consists of the AC component (Vpp) superimposed on the DC component (V), and the time-averaged value of the superimposed bias coincides with the offset voltage Voff.

When the AC component having the same peak value on the positive side as the peak value on the negative side with 0V in the center is superimposed on the DC component having a voltage of −bV, the superimposed bias has thus a sinusoidal waveform being offset negatively and includes both the peak value "+(a−b)V" on the positive side and the peak value "−(a+b)V" on the negative side.

As illustrated on the right side of FIG. 3, the superimposed bias on the positive side above 0V acts on the toner such that the toner returns from the recording medium side to the belt side. By contrast, the superimposed bias on the negative side below 0V acts on the toner such that the toner moves from the belt side to the recording medium side in the secondary transfer nip. Making the offset voltage Voff, which is the time averaged value, the same polarity as the toner (here, negative polarity) enables the toner to move from the belt side to the recording medium comparatively, while moving back and forth reciprocally between the belt side and the recording medium side.

In a case in which a recording medium having a coarse surface, that is, having a high degree of surface roughness, such as an embossed sheet and a Japanese sheet is used, it is known that application of the superimposed bias enables the toner to move from the belt side to the recording medium comparatively while moving the toner reciprocally so that transferability of toner relative to the recessed portions on the recording medium is enhanced, hence preventing a disturbance of an image such as dropouts (blank spots). The positive side of the superimposed bias contributes to enhancement of transferability relative to the coarse surface of the recording medium. By contrast, the negative side of the superimposed bias relates to what is needed for normal transfer (transfer of toner from the belt side to the recording medium side).

According to the illustrative embodiment of the present invention, the image forming apparatus is capable of forming a full color or multiple-color image with at least toner of two colors in addition to a monochrome or single-color image using toner of a single color. When compared with transfer of a monochrome (single color) image using toner of a single color, transfer of the full color or multiple-color image (hereinafter referred to simply as color image) containing a large amount of toner requires higher transferability.

However, it is known that when using the AC transfer method in which the AC voltage is superimposed on the DC voltage, the transferability is not enhanced proportional to the transfer voltage. More specifically, simply increasing the transfer voltage does not transfer well the color toner image bearing a large amount of toner. Referring now to FIG. 4, there is provided a waveform chart showing an example of a waveform when the color image is not transferred well.

Assuming that good transferability is achieved with the superimposed bias as illustrated in FIG. 3 when forming a monochrome image with toner of black in a monochrome mode (single-color mode), when the voltage of the DC component is increased from "−bV" as shown in FIG. 3 to "−cV" as shown in FIG. 4 (c>b) to accommodate a color mode in which a color image is formed using a relatively large amount of toner, an offset voltage (absolute value) becomes large in the waveform of the superimposed bias as illustrated in FIG. 4 (on the right side). However, the positive side above 0V indicated by an arrow, that is, the electric field acting on the toner to return from the recording medium side to the belt side is reduced (less than FIG. 3). As a result, reciprocal movement of toner which is the characteristic of the superimposed bias is reduced, and thus transferability is not enhanced even when the transfer voltage (here, the DC voltage) is increased.

Figure 5:
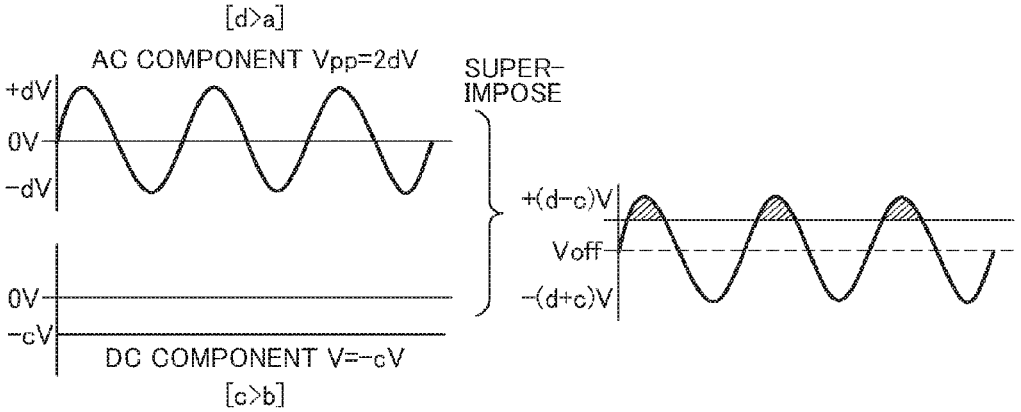
FIG. 5 is a waveform chart showing an example of a waveform of a superimposed bias in a color mode according to an illustrative embodiment of the present invention.

In view of the above, according to an illustrative embodiment as illustrated in FIG. 5, when carrying out the color mode for forming a color image consisting of a large amount of toner, levels of both the DC voltage and the AC voltage employed in the monochrome (single color) mode are changed such that a so-called return electric field that causes the toner to return from the recording medium side to the belt side is secured. More specifically, as illustrated in FIG. 5, an area (crest) above 0V indicated by hatched lines on the positive side is secured (by an amount equal to or greater than the monochrome (single color) mode). FIG. 5 is a waveform chart showing an example of the waveform of the superimposed bias in the color mode according to the illustrative embodiment of the present invention.

With this configuration, as compared with the configuration shown in FIG. 3, the transferability (the electric field to enable the toner to move from the belt side to the recording medium) is kept high by raising the offset voltage while maintaining the return electric field (the area above the 0V on the positive side) at the same level or greater than that in the single color mode. Accordingly, good transferability is achieved in the color mode at which a color image such as a full color image and a multiple color image that contains a large amount of toner is transferred onto the recording medium. Because the return electric field is secured, sufficient transferability relative to the recessed portions on the recording medium having a coarse surface can be achieved.

According to the present embodiment, both the DC component and the AC component of the superimposed bias are voltage-controlled. Alternatively, the DC component may be current-controlled. A power source capable of current-control is generally expensive. Thus, as for the AC component, even when the DC component is current-controlled, the AC component is voltage-controlled.

A description is now provided of an example of the voltage control (Embodiment 1) and the current control (Embodiment 2). In Embodiment 1, both the DC component and the AC component are voltage-controlled. In Embodiment 2, the DC component is current-controlled. The evaluation of the transferability was performed using a textured paper called "LEATHAC 66" (a trade name, manufactured by TOKUSHU PAPER MFG. CO., LTD.) having a ream weight of 130 Kg.

When both the DC component and the AC component were constant-voltage controlled (Embodiment 1), the voltage of the DC component of the superimposed bias in the monochrome mode (the single color mode) with black color was −0.8 kV and the peak-to-peak voltage of the AC component was 7 kV. Accordingly, good transferability was obtained.

The transferability was graded on a five point scale of 1 to 5, where 5 is the highest grade in an organoleptic test. With the above-described voltages, the highest grade "5" was obtained. When the above-described values are applied to the chart shown in FIG. 3, when a=±3.5 kV, Vpp of the AC component is Vpp=2 aV=7 kV, while the voltage V of the DC component is −bV=−0.8 kV. The peak of the voltage on the toner return side of the superimposed bias is +(a−b)=+2.7 kV, and the absolute value is 2.7 kV. However, when the transferability in the color mode was graded using the same voltages, the transferability was graded as "1", the lowest grade.

In view of the above, when the level of the voltage of the DC component was raised to −0.9 V and the level of the peak-to-peak voltage of the AC component was raised to 9 kV, the transferability was graded as "5". When the above-described values are applied to the chart shown in FIG. 5, when d=±4.5 kV, Vpp of the AC component is Vpp=2 dV=9 kV while the voltage V of the DC component is −cV=−0.9 kV. The peak of the voltage on the toner return side of the superimposed bias is +(d−c)=+3.6 kV, and the absolute value is 3.6 kV. It is to be noted that both the DC and the AC are constant-voltage controlled. Even when the toner image contains a large amount of toner such as in the color mode, the toner can be moved reciprocally by securing the absolute value of the voltage on the toner return side at the same level or higher than that in the single color mode. With this configuration, good transferability is obtained.

Next, a description is provided of Embodiment 2 in which the DC component is constant-current controlled (the AC component is constant-voltage controlled). The current of the DC component of the superimposed bias in the monochrome mode (the single color mode) using the black toner was −18 μA, and the peak-to-peak voltage of the AC component was 8 kV. Good transferability was obtained. The transferability was graded on the five point scale of 1 to 5, where 5 is the highest grade in the organoleptic test. With the above-described current and voltage, the transferability was graded as "5". However, when the transferability in the color mode was graded using the same condition, the transferability was graded as "1", the lowest grade.

In view of the above, by increasing the level of the current of the DC component to −22 μA and the level of the peak-to-peak voltage of the AC component to 9 kV, the transferability was graded as "5". It is to be noted that the DC component was constant-current controlled, and the AC component was constant-voltage controlled. As compared with the constant-voltage controlled DC component, when the DC component is constant-current controlled, the ability to accommodate different environmental conditions and sheet types can be enhanced.

According to the illustrative embodiment, the image forming apparatus includes a controller 500 that controls the superimposed bias to be applied by the transfer bias power source. The controller 500 changes, in the color mode, both levels of the DC component and the AC component of the superimposed bias from that in the single color mode such that the return electric field is secured in the superimposed bias in the color mode. With this configuration, good transferability can be obtained in the color mode in which the toner image generally bears a large amount of toner. Furthermore, the toner image can be transferred reliably onto the recessed portions of the recording medium P having a high degree of surface roughness (coarse surface).

The values presented in Embodiment 1 and Embodiment 2 are only an example using a test apparatus, and thus the levels of voltages and currents are not limited to the embodiments described above. The voltages and currents may be set depending on the material of the components of the transfer device and the characteristics of toner.

In the color mode, even when a toner image contains a large amount of toner, the toner can be moved reciprocally by securing the same level of the return electric field or higher than that in the single color mode. Accordingly, good transferability is obtained. Further, good transferability is also obtained relative to the recording media sheets having a coarse surface.

In the color mode, even when a toner image contains a large amount of toner, improper transfer of the toner image can be prevented by increasing the applied bias (voltage and/or current) greater than that in the single color mode, thereby obtaining good transferability. Further, good transferability is also obtained relative to the recording media sheets having a coarse surface.

In a case in which both the DC component and the AC component of the superimposed bias are constant-voltage controlled, the cost of components constituting the power supply is suppressed.

Further, when compared with the constant-voltage control, as the DC component of the superimposed bias is constant-current controlled, the ability to accommodate different environmental conditions and different sheet types can be enhanced.

According to Embodiment 1 and Embodiment 2, the bias is switched between the single color mode and the color mode. In addition, the bias may be changed depending on different types of recording media sheets. For example, when using a recording medium having a coarse surface in the color mode, the voltage and/or the current of the superimposed bias greater than the values presented in the foregoing embodiments may be applied.

As is generally the case in the image forming apparatus serving as a copier, the type of the recording medium is selectable on a control panel of the image forming apparatus. In a case of a printer, the type of the recording medium can be selected in the print setting of a host machine. Generally, the color mode is also selectable. When the color mode and the recording medium having a coarse surface are selected, for example, as both the DC component and the AC component are voltage-controlled, the level of the voltage of the DC component is set to −0.9 V and the peak-to-peak voltage of the AC component is set to 10 kV.

Next, a description is provided of examples of control associated with different types of recording media sheets according to Embodiments 3 through 6. Similar to Embodiment 2, in Embodiments 3 through 6 the DC component is constant-current controlled while the AC component is constant-voltage controlled.

Embodiment 3

A description is provided of Embodiment 3. In the present embodiment, a test sheet A has a volume resistivity of 10.77 [Log Ω·cm]. A surface resistivity of the front surface is 12.76 [Log Ω/□]. The surface resistivity of the rear surface is 12.40 [Log Ω/□]. The depth of a recessed portion of the surface is approximately 50 μm. The depth of the recessed portion refers to the longest distance between the highest peak and the lowest valley on the surface of the test sheet. The depth was measured using the laser microscope VK-9500 manufactured by Keyence Corporation.

The level of current of the DC component of the superimposed bias in the monochrome mode (single color mode) using the toner of black was −40 μA, and the peak-to-peak voltage of the AC component was 3.7 kV. The transferability was graded on the five point scale of 1 to 5, where 5 is the highest grade in the organoleptic test. With the above-described current and voltage, the transferability was graded as "5".

The level of the voltage of the DC component when transferring the toner image onto the test sheet A was −0.7 kV under a normal environment with the temperature of 23° C. and the relative humidity of 50%. The DC component of the bias was constant-current controlled so that the voltage at transfer fluctuated due to environmental changes. However, the fluctuation was within ±30% of −0.7 kV.

However, when the transferability in the color mode was evaluated using the same values, the transferability was graded as "1". In view of the above, the level of current of the DC component was increased to −70 μA and the peak-to-peak voltage of the AC component was increased to 6.2 kV. As a result, the transferability was graded as "5".

When transferring the toner image onto the test sheet A, the level of the voltage of the DC component was −1 kV under the normal environment with the temperature of 23° C. and the relative humidity of 50%. The DC component of the bias was constant-current controlled so that the voltage at transfer fluctuated due to environmental changes. However, the fluctuation was within ±30% of −1 kV in a low-temperature, low-humidity environment as well as in a high-temperature, high-humidity environment.

It is to be noted that the DC component was constant-current controlled while the AC component was constant-voltage controlled. When compared with the constant-voltage control of the DC component, as the DC component of the superimposed bias is constant-current controlled, the ability to accommodate different environmental conditions and different sheet types can be enhanced.

In the image forming apparatus that controls transfer of a toner image using the superimposed bias, good transferability can be obtained in the color mode by changing both the DC component and the AC component of the superimposed bias of the single color mode to the color mode in which the toner image bears a large amount of toner so that the return electric field is secured in the superimposed bias. Furthermore, with this configuration, the toner image can be transferred reliably onto the recessed portions of the recording medium having a high degree of surface roughness (coarse surface).

When the above-described voltages are applied to the chart in FIG. 3, when a=±1.85 kV, Vpp of the AC component is Vpp=2 aV=3.7 kV while the voltage V of the DC component is V=−bV=−0.7 kV. The peak of the voltage on the toner return side in the superimposed bias is +(a−b)=+1.15 kV, and the absolute value is 1.15 kV. However, when the transferability in the color mode was evaluated using the same voltages, the transferability was graded as "1".

In view of the above, when the level of the voltage of the DC component was raised to −1.0 kV and the level of the peak-to-peak voltage of the AC component was raised to 6.2 kV, the transferability was graded as "5". When the above values are applied to the chart shown in FIG. 5, when d=±13.1 kV, Vpp of the AC component is Vpp=2 dV=6.2 kV while the voltage V of the DC component is V=−cV=−1.0 kV. The peak of the voltage on the toner return side in the superimposed bias is +(d−c)=+2.1 kV, and the absolute value is 2.1 kV. It is to be noted that both the DC and the AC are constant-voltage controlled. In the color mode, even when the toner image contains a large amount of toner, the toner can be moved reciprocally by securing the absolute value of the voltage on the toner return side at the same level or higher than that in the single color mode.

The DC component of the bias was constant-current controlled so that the voltage at transfer fluctuated due to environmental changes and so forth. However, similar to the normal environment with the temperature of 23° C. and the relative humidity of 50%, the absolute value (kV) of the voltage on the toner return side in the color mode was equal to or greater than that in the monochrome (single color) mode in a low-temperature, low-humidity environment as well as in a high-temperature, high-humidity environment.

Embodiment 4

A description is provided of Embodiment 4. In the present embodiment, a test sheet B has the volume resistivity of 10.96 [Log Ω·cm]. The surface resistivity of the front surface is 13.10 [Log Ω/□]. The surface resistivity of the rear surface is 13.25 [Log Ω/□]. The depth of a recessed portion is approximately 100 μm.

It is to be noted that the depth of the recessed portion refers to the longest distance between the highest peak and the lowest valley on the surface of the test sheet. The depth was measured using the laser microscope VK-9500 manufactured by Keyence Corporation.

The level of current of the DC component of the superimposed bias in the monochrome mode (single color mode) using the black toner was −40 μA, and the peak-to-peak voltage of the AC component was 4.0 kV. Good transferability was obtained. The transferability was graded on the five point scale of 1 to 5, where 5 is the highest grade in the organoleptic test. With the above-described current and voltage, the transferability was graded as "5".

When transferring a toner image onto the test sheet B, the level of the voltage of the DC component was −0.7 kV under the normal environment with the temperature of 23° C. and the relative humidity of 50%. The DC component of the bias was constant-current controlled so that the voltage at transfer fluctuated due to environmental changes and so forth. However, the fluctuation was within ±30% of −0.7 kV. When the transferability in the color mode was evaluated using the same values, the transferability was graded as "1".

In view of the above, the level of the current of the DC component was raised to −70 μA and the peak-to-peak voltage of the AC component was raised to 6.4 kV, the transferability was graded as "5".

When transferring the toner image onto the test sheet B, the level of the voltage of the DC component was −1.1 kV under the normal environment with the temperature of 23° C. and the relative humidity of 50%. The DC component of the bias was constant-current controlled so that the voltage at transfer fluctuated due to environmental changes and so forth. However, the fluctuation was within ±30% of −1.1 kV in a low-temperature, low-humidity environment as well as a high-temperature, high humidity environment.

It is to be noted that the DC component was constant-current controlled while the AC component was constant-voltage controlled. When compared with the constant-voltage control of the DC component, as the DC component of the superimposed bias is constant-current controlled, the ability to accommodate different environmental conditions and different sheet types can be enhanced.

In the image forming apparatus that controls transfer of a toner image using the superimposed bias, good transferability can be obtained in the color mode by changing both the DC component and the AC component of the superimposed bias of the single color mode to the color mode in which the toner image bears a large amount of toner so that the return force of toner is secured in the superimposed bias. Furthermore, with this configuration, the toner image can be transferred reliably onto the recessed portions of the recording medium having a high degree of surface roughness (coarse surface).

When the above-described values are applied to the chart shown in FIG. 3, when a=±2.0 kV, Vpp of the AC component is Vpp=2 aV=4.0 kV while the voltage V of the DC component is −bV=−0.7 kV. The peak of the voltage on the toner return side in the superimposed bias is +(a−b)=+1.30 kV, and the absolute value is 1.30 kV. However, when the transferability in the color mode was evaluated using the same voltages, the transferability was graded as "1".

In view of the above, when the level of the voltage of the DC component was raised to −1.1 kV and the level of the peak-to-peak voltage of the AC component was raised to 6.4 kV, the transferability was graded as "5". When the above values are applied to the chart shown in FIG. 5, when d=±3.2 kV, Vpp of the AC component is Vpp=2 dV=6.4 kV while the voltage V of the DC component is V=−cV=−1.1 kV. The peak of the voltage on the toner return side in the superimposed bias is +(d−c)=+2.1 kV, and the absolute value is 2.1 kV. It is to be noted that both the DC and the AC are constant-voltage controlled.

In the color mode, even when the toner image contains a large amount of toner, the toner can be moved reciprocally by securing the absolute value of the voltage on the toner return side at the same level or higher than that in the single color mode. With this configuration, good transferability is obtained.

The DC component of the bias was constant-current controlled so that the voltage at transfer fluctuated due to environmental changes and so forth. However, similar to the normal environment with the temperature of 23° C. and the relative humidity of 50%, the absolute value (kV) of the voltage on the toner return side in the color mode was equal to or greater than that in the monochrome (single color) mode in a low-temperature, low-humidity environment as well as in a high-temperature, high-humidity environment.

Embodiment 5

A description is now provided of Embodiment 5. In the present embodiment, a test sheet C has the volume resistivity of 11.18 [Log Ω·cm]. The surface resistivity of the front surface is 12.99 [Log Ω/□]. The surface resistivity of the rear surface is 13.11 [Log Ω/□]. The depth of a recessed portion is approximately 80 μm.

The depth of the recessed portion refers to the longest distance between the highest peak and the lowest valley on the surface of the test sheet. The depth was measured using the laser microscope VK-9500 manufactured by Keyence Corporation.

The level of the current of the DC component of the superimposed bias in the monochrome mode (single color mode) using the black toner was −40 μA, and the peak-to-peak voltage of the AC component was 4.3 kV. The transferability was graded on the five point scale of 1 to 5, where 5 is the highest grade in the organoleptic test. With the above-described current and voltage, the transferability was graded as "5".

When transferring the toner image onto the test sheet C, the level of the voltage of the DC component was −0.9 kV under the normal environment with the temperature of 23° C. and the relative humidity of 50%. The DC component of the bias was constant-current controlled so that the voltage at transfer fluctuated due to environmental changes and so forth. However, the fluctuation was within ±30% of −0.9 kV.

When the transferability in the color mode was evaluated using the same values, the transferability was graded as "1". In view of the above, the level of the current of the DC component was raised to −70 μA and the peak-to-peak voltage of the AC component was raised to 6.7 kV. The transferability was graded as "5".

When transferring the toner image onto the test sheet C, the level of the voltage of the DC component was −1.3 kV under the normal environment with the temperature of 23° C. and the relative humidity of 50%. The DC component of the bias was constant-current controlled so that the voltage at transfer fluctuated due to environmental changes and so forth. However, the fluctuation was within ±30% of −1.3 kV in a low-temperature, low-humidity environment as well as a high-temperature and high-humidity environment.

It is to be noted that the DC component was constant-current controlled while the AC component was constant-voltage controlled. When compared with the constant-voltage control of the DC component, as the DC component of the superimposed bias is constant-current controlled, the ability to accommodate different environmental conditions and different sheet types can be enhanced.

In the image forming apparatus that transfers a toner image using the superimposed bias, good transferability can be obtained in the color mode by changing both the DC component and the AC component of the superimposed bias of the single color mode to the color mode in which the toner image bears a large amount of toner so that the return force of toner is secured in the superimposed bias. Furthermore, with this configuration, the toner image can be transferred reliably onto the recessed portions of the recording medium having a high degree of surface roughness (coarse surface).

When the above-described voltages are applied to the chart shown in FIG. 3, when a=±2.15 kV, Vpp of the AC component is Vpp=2 aV=4.3 kV while the voltage V of the DC component is −bV=−0.9 kV. The peak of the voltage on the toner return side in the superimposed bias is +(a−b)=+1.25 kV, and the absolute value is 1.25 kV. However, when the transferability in the color mode was evaluated using the same voltages, the transferability was graded as "1".

In view of the above, when the level of the voltage of the DC component was raised to −1.3 kV and the level of the peak-to-peak voltage of the AC component was raised to 6.7 kV, the transferability was graded as "5". When the above values are applied to the chart shown in FIG. 5, when d=±3.35 kV, Vpp of the AC component is Vpp=2 dV=6.7 kV while the voltage V of the DC component is V=−cV=−1.3 kV. The peak of the voltage on the toner return side in the superimposed bias is +(d−c)=+2.05 kV, and the absolute value is 2.05 kV. It is to be noted that both the DC and the AC are constant-voltage controlled.

In the color mode, even when the toner image contains a large amount of toner, the toner can be move reciprocally by securing the absolute value of the voltage on the toner return side at the same level or higher than that in the monochrome or single color mode. With this configuration, good transferability is obtained.

The DC component of the bias was constant-current controlled so that the voltage at transfer fluctuated due to environmental changes and so forth. However, similar to the normal environment with the temperature of 23° C. and the relative humidity of 50%, the absolute value (kV) of the voltage on the toner return side in the color mode was equal to or greater than that in the monochrome mode in a low-temperature, low-humidity environment as well as in a high-temperature, high-humidity environment.

Embodiment 6

A description is provided of Embodiment 6. In the present embodiment, a test sheet D has a volume resistivity of 10.92 [Log Ω·cm]. The surface resistivity of the front surface is 12.62 [Log Ω/□]. The surface resistivity of the rear surface is 12.37 [Log Ω/□]. The depth of a recessed portion is approximately 110 μm.

It is to be noted that the depth of the recessed portion refers to the longest distance between the highest peak and the lowest valley on the surface of the test sheet. The depth was measured using the laser microscope VK-9500 manufactured by Keyence Corporation.

The level of current of the DC component of the superimposed bias in the monochrome mode (single color mode) using the black toner was −40 μA, and the peak-to-peak voltage of the AC component was 5.5 kV. Good transferability was obtained. The transferability was graded on the five point scale of 1 to 5, where 5 is the highest grade in the organoleptic test. With the above-described current and voltage, the transferability was graded as "5".

The level of the voltage of the DC component when transferring a toner image onto the test sheet D was −1.4 kV under the normal environment with the temperature of 23° C. and the relative humidity of 50%. The DC component of the bias was constant-current controlled so that the voltage at transfer fluctuated due to environmental changes and so forth. However, the fluctuation was within ±30% of −1.4 kV.

However, when the transferability in the color mode was evaluated using the same values, the transferability was graded as "1". By increasing the level of current of the DC component to −70 μA and increasing the peak-to-peak voltage of the AC component to 8.9 kV, the transferability was graded as "5".

The level of the voltage of the DC component when transferring a toner image onto the test sheet D was −2.1 kV under the normal environment with the temperature of 23° C. and the relative humidity of 50%. The DC component of the bias was constant-current controlled so that the voltage at transfer fluctuated due to environmental changes and so forth. However, the fluctuation was within ±30% of −2.1 kV in a low-temperature, low-humidity environment as well as high-temperature, high humidity environment.

It is to be noted that the DC component was constant-current controlled while the AC component was constant-voltage controlled. When compared with the constant-voltage control of the DC component, as the DC component of the superimposed bias is constant-current controlled, the ability to accommodate different environmental conditions and different sheet types can be enhanced.

In the image forming apparatus that transfers a toner image using the superimposed bias, good transferability can be obtained in the color mode by switching both the DC component and the AC component of the superimposed bias of the single color mode to the color mode in which the toner image bears a large amount of toner such that the return force of toner is secured in the superimposed bias. Furthermore, with this configuration, the toner image can be transferred reliably onto the recessed portions of the recording medium having a high degree of surface roughness (coarse surface).

When the above-described voltages are applied to the chart shown in FIG. 3, when a=±2.75 kV, Vpp of the AC component is Vpp=2 aV=5.5 kV while the voltage V of the DC component is −bV=−1.4 kV. The peak of the voltage on the toner return side in the superimposed bias is +(a−b)=+1.35 kV, and the absolute value is 1.35 kV. However, when the transferability in the color mode was evaluated using the same values, the transferability was graded as "1".

In view of the above, by increasing the level of the voltage of the DC component to −2.1 kV and increasing the level of the peak-to-peak voltage of the AC component to 8.9 kV, the transferability was graded as "5". When the above values are applied to the chart shown in FIG. 5, when d=±4.45 kV, Vpp of the AC component is Vpp=2 dV=8.9 kV while the voltage V of the DC component is V=−cV=−2.1 kV. The peak of the voltage on the toner return side in the superimposed bias is +(d−c)=+2.35 kV, and the absolute value is 2.35 kV. It is to be noted that both the DC and the AC are constant-voltage controlled.

In the color mode, even when the toner image contains a large amount of toner, the toner can move reciprocally by securing the absolute value of the voltage on the toner return side at the same level or higher than that in the single color mode. Accordingly, good transferability is obtained.

The DC component of the bias was constant-current controlled so that the voltage at transfer fluctuated due to environmental changes and so forth. However, similar to the normal environment with the temperature of 23° C. and the relative humidity of 50%, the absolute value (kV) of the voltage on the toner return side in the color mode was equal to or greater than that in the monochrome mode in a low-temperature, low-humidity environment as well as in a high-temperature, high-humidity environment.

Embodiment 7

Next, a description is provided of Embodiment 7 in which a plurality of modes for providing different superimposed biases corresponding to output images is provided.

According to the present embodiment, the plurality of modes includes a normal mode, a halftone priority mode, and a solid image priority mode. In the halftone priority mode, the peak-to-peak voltage of the AC component of the superimposed bias is less than the normal mode. In the solid image priority mode, the peak-to-peak voltage of the AC component of the superimposed bias is greater than the normal mode.

An amount of toner per unit area (corresponding to a ratio of an image area of a recording medium) in an output image differs depending on images. As the amount of toner differs in images, an optimum voltage and current by which the toner is transferred to the recording medium also change. More specifically, the optimum voltage and current refer to the voltage and current by which the toner is transferred well comparatively to the recessed portions of the recording medium while moving the toner reciprocally, thereby preventing degradation of transferability and an image defect such as dropouts.

In view of the above, a user or a technician chooses, in accordance with an image to be output, a proper print mode from the plurality of print modes on the control panel of the image forming apparatus or a print setting of a host machine. For example, in a case of an image having a low toner density, for example, the color of an image is mostly gray, the halftone priority mode is selected. In a case of an image having a high toner density, the solid image priority mode is selected. With this configuration, toner can be transferred optimally with an optimum voltage and current corresponding to the amount of toner. In other words, the toner is transferred well to the recessed portions of the recording medium, thereby preventing degradation of transferability and an image defect such as dropouts.

In a case in which the test sheet A is used and the normal mode is selected, the superimposed bias in the monochrome (single color) mode with the color black is set as −40 μA for the current of the DC component and 3.7 kV for the peak-to-peak voltage of the AC component.

When the halftone priority mode is selected, the current of the DC component is set to −40 μA and the peak-to-peak voltage of the AC component is set to 3.2 kV. When the solid image priority mode is selected, the current of the DC component is set to −40 μA and the peak-to-peak voltage of the AC component is set to 4.6 kV.

By contrast, when the normal mode is selected in the color mode, the superimposed bias is set to −70 μA for the current of the DC component, and 6.2 kV for the peak-to-peak voltage of the AC component. When the halftone priority mode is selected, the current of the DC component is set to −70 μA and the peak-to-peak voltage of the AC component is set to 5.4 kV. When the solid image priority mode is selected, the current of the DC component is set to −70 μA and the peak-to-peak voltage of the AC component is set to 7.0 kV.

In a case in which the test sheet B is used and the normal mode is selected, the superimposed bias in the monochrome (single color) mode with the color black is set to −40 μA for the current of the DC component, and 4.0 kV for the peak-to-peak voltage of the AC component. When the halftone priority mode is selected, the current of the DC component is set to −40 μA and the peak-to-peak voltage of the AC component is set to 3.3 kV. When the solid image priority mode is selected, the current of the DC component is set to −40 μA and the peak-to-peak voltage of the AC component is set to 4.9 kV.

By contrast, when the normal mode is selected in the color mode, the superimposed bias is set to −70 μA for the current of the DC component, and 6.4 kV for the peak-to-peak voltage of the AC component. When the halftone priority mode is selected, the current of the DC component is set to −70 μA and the peak-to-peak voltage of the AC component is set to 5.6 kV. When the solid image priority mode is selected, the current of the DC component is set to −70 μA and the peak-to-peak voltage of the AC component is set to 7.3 kV.

In a case in which the test sheet C is used and the normal mode is selected, the superimposed bias in the monochrome (single color) mode with the color black is set to −40 μA for the current of the DC component and 4.3 kV for the peak-to-peak voltage of the AC component. When the halftone priority mode is selected, the current of the DC component is set to −40 μA and the peak-to-peak voltage of the AC component is set to 3.6 kV. When the solid image priority mode is selected, the current of the DC component is set to −40 μA and the peak-to-peak voltage of the AC component is set to 5.5 kV.

By contrast, in the color mode, the superimposed bias when the normal mode is selected is set as −70 μA for the current of the DC component, and 6.7 kV for the peak-to-peak voltage of the AC component. When the halftone priority mode is selected, the current of the DC component is set to −70 μA and the peak-to-peak voltage of the AC component is set to 6.0 kV. When the solid image priority mode is selected, the current of the DC component is set to −70 μA and the peak-to-peak voltage of the AC component is set to 8.0 kV.

In a case in which the test sheet D is used and when the normal mode is selected, the superimposed bias in the monochrome (single color) mode with the color black is set to −40 μA for the current of the DC component, and 5.5 kV for the peak-to-peak voltage of the AC component. When the halftone priority mode is selected, the current of the DC component is set to −40 μA and the peak-to-peak voltage of the AC component is set to 4.1 kV. When the solid image priority mode is selected, the current of the DC component is set to −40 μA and the peak-to-peak voltage of the AC component is set to 6.5 kV.

By contrast, when the normal mode is selected in the color mode, the superimposed bias is set to −70 to for the current of the DC component, and 8.9 kV for the peak-to-peak voltage of the AC component. When the halftone priority mode is selected, the current of the DC component is set to −70 μA and the peak-to-peak voltage of the AC component is set to 7.9 kV. When the solid image priority mode is selected, the current of the DC component is set to −70 μA and the peak-to-peak voltage of the AC component is set to 10.0 kV.

Accordingly, toner can be transferred well with an optimum voltage and current corresponding to the amount of toner by adjusting the superimposed transfer bias in accordance with an output image. In other words, the toner is transferred well to the recessed portions of the recording medium, thereby preventing degradation of transferability and an image defect such as dropouts.

The values presented in the foregoing embodiments are only an example using a certain apparatus, and thus the values for voltages and currents are not limited to the embodiments described above. The voltages and currents may be set depending on the material of the components of the transfer device and the characteristics of toner.

According to the illustrative embodiments described above, the secondary transfer nip is formed by interposing the secondary transfer belt 51 between the secondary transfer roller 53 and the nip forming roller 56 contacting pressingly against the secondary transfer roller 53. Alternatively, a belt-type nip forming member (conveyance belt, also known as a transfer belt) may be employed.

The secondary transfer portion may employ a contact-free system. More specifically, a contact-free transfer charger serving as a transfer device is disposed facing the secondary transfer roller 53 without contacting the secondary transfer roller 53. In this case, the polarity of the DC component of the superimposed bias is the opposite polarity to the polarity of the charge on toner. The toner image on the intermediate transfer belt 51 is transferred onto the recording medium delivered between the secondary transfer roller 53 and the intermediate transfer belt 51, and the transfer charger by absorbing the toner image to the recording medium.

Figure 6:
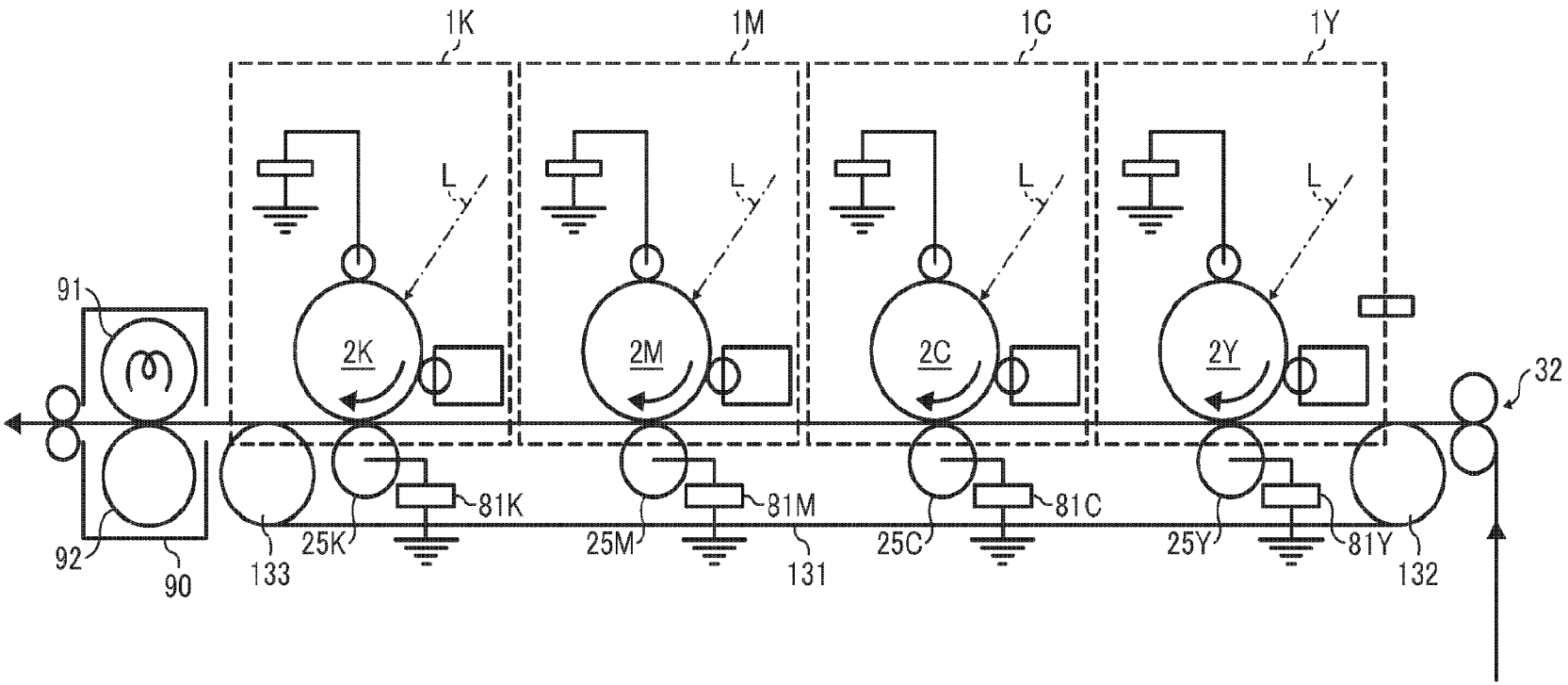
FIG. 6 is a cross-sectional diagram schematically illustrating a color printer of a direct transfer method as an example of an image forming apparatus according to an illustrative embodiment of the invention.

According to the illustrative embodiments described above, the image forming apparatus employs an intermediate transfer method in which the toner image formed on the photosensitive member is transferred primarily onto the intermediate transfer belt, and then transferred onto a recording medium. Alternatively, the image forming apparatus may employ a direct transfer method in which the toner image formed on the photosensitive member is transferred directly onto a recording medium as illustrated in FIG. 6. FIG. 6 is a cross-sectional diagram schematically illustrating an image forming apparatus of the direct transfer method.

More specifically, in the image forming apparatus of the direct transfer method as illustrated in FIG. 6, the recording medium is fed onto a conveyance belt 131 by a sheet feed roller 32, and the toner images on photosensitive drums 2Y, 2C, 2M, and 2K are transferred directly onto the recording medium by transfer rollers 25Y, 25C, 25M, and 25K, respectively, such that they are superimposed one atop the other, thereby forming a composite toner image. Subsequently, the composite toner image is fixed by the fixing device 90. The conveyance belt 131 is formed into a loop and entrained about support rollers 132 and 133. The transfer rollers 25K, 25M, 25C, and 25Y are connected to power sources 81K, 81M, 81C, and 81Y, respectively.

A superimposed bias in which an AC voltage is superimposed on a DC voltage is used as the transfer bias to be applied to each of the transfer portions. As described above, in the color mode, both the DC component and the AC component of the superimposed bias of the single color mode are changed to the color mode such that the return electric field is secured in the superimposed bias.

Figure 7:
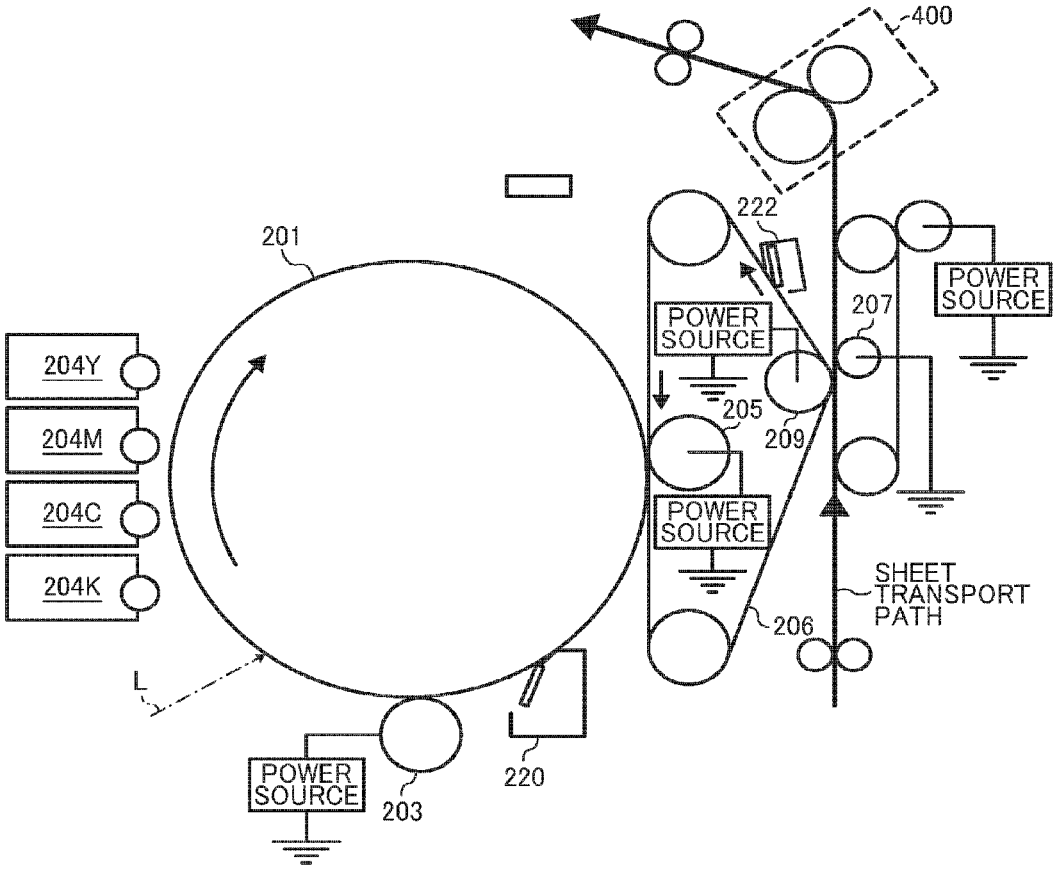
FIG. 7 is a cross-sectional diagram schematically illustrating a color image forming apparatus employing a single drum-type photosensitive member according to an illustrative embodiment of the present invention.

The present invention may be applied to a color image forming apparatus using a single photosensitive member (which may be a photosensitive drum) such as illustrated in FIG. 7. FIG. 7 is a cross-sectional diagram schematically illustrating a color image forming apparatus using a single photosensitive member. The image forming apparatus of this type includes one photosensitive drum 201 surrounded by a charging device 203, a primary transfer roller 205, and developing devices 204Y, 204M, 204C, and 204K for the colors yellow, magenta, cyan, and black, respectively.

When forming an image, the surface of the photosensitive drum 201 is charged uniformly by the charging device 203. Subsequently, the charged surface of the photosensitive drum 201 is illuminated with a light beam L modulated based on image data associated with the color yellow. Accordingly, an electrostatic latent image for the color yellow is formed on the surface of the photosensitive drum 201.

The developing unit 204Y develops the electrostatic latent image for yellow with yellow toner, thereby forming a toner image of yellow. As described above, the toner image of yellow formed on the photosensitive drum 201 is transferred primarily onto an intermediate transfer belt 206 by the primary transfer roller 205. After the toner image is transferred, residual toner remaining on the photosensitive drum 201 is cleaned by a drum cleaner 220. Subsequently, the surface of the photosensitive drum 201 is uniformly charged by the charging device 203 in preparation for the subsequent imaging process.

Next, the surface of the photosensitive drum 201 is illuminated with a light beam L modulated based on image data associated with the color magenta. Accordingly, an electrostatic latent image for the color magenta is formed on the surface of the photosensitive drum 201.

The developing unit 204M develops the electrostatic latent image for magenta with magenta toner, thereby forming a toner image of magenta. As described above, the toner image of magenta formed on the photosensitive drum 206 is transferred onto the intermediate transfer belt 206, such that the toner image of magenta is superimposed on the toner image of yellow.

For the colors cyan and black, the toner images of cyan and black are transferred primarily onto the intermediate transfer belt 206 in the similar manner as the color magenta, thereby forming a composite toner image. As the recording medium is conveyed to a secondary transfer nip at which the intermediate transfer belt 206 is interposed between a secondary transfer roller 209 and a nip forming roller 207, and the composite color toner image is transferred onto the recording medium. The recording medium bearing the composite toner image thereon is delivered to a fixing device 400.

After transfer, the surface of the intermediate transfer belt 206 is cleaned by a belt cleaner 222 in preparation for subsequent imaging process. In the fixing device 400, heat and pressure are applied to the recording medium to fix the composite toner image on the recording medium. After fixing, the recording medium is output onto a sheet discharge tray, not illustrated.

As described above, the secondary transfer portion of the single-drum type color image forming apparatus is constituted by the secondary transfer roller 209 and the nip forming roller 207. Similar to the image forming apparatus shown in FIG. 1, the nip forming roller 207 is grounded while the superimposed bias is supplied to secondary transfer roller 209. As described above, in the color mode, both the DC component and the AC component of the superimposed bias of the single color mode are changed to the color mode such that the return electric field is secured in the superimposed bias.

Figure 8:
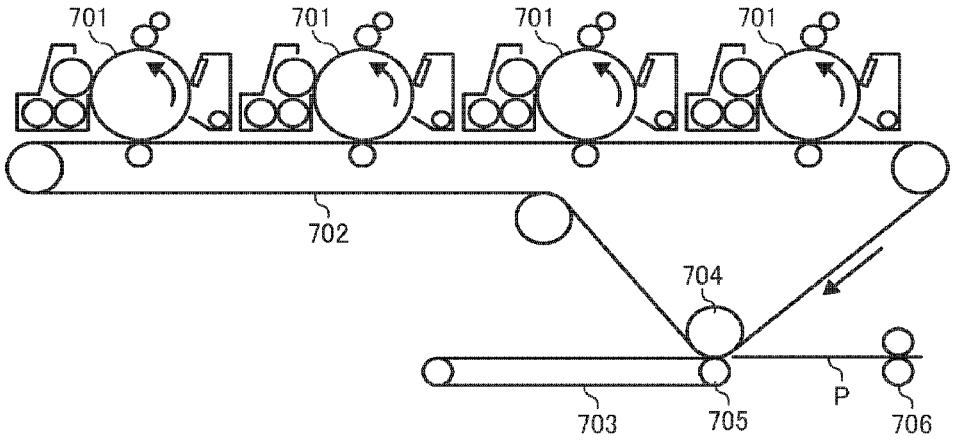
FIG. 8 is a schematic diagram illustrating a variation of a transfer portion of the image forming apparatus.

With reference to FIG. 8, a description is now provided of a variation of a configuration constituting a transfer portion. FIG. 8 is a schematic diagram illustrating a variation of the transfer portion. The same effect as that of the foregoing embodiments can be achieved with this configuration.

According to the present embodiment, toner images formed on photosensitive drums 701 are primarily transferred onto a belt-type intermediate transfer member 702 (hereinafter referred to simply as an intermediate transfer belt). The intermediate transfer belt 702 contacts a secondary transfer conveyance belt 703, thereby forming a transfer nip. The toner image is transferred onto a recording medium P at the transfer nip.

After the recording medium P is fed by a pair of registration rollers 706, the recording medium P passes through the transfer nip between the intermediate transfer belt 702 and the secondary transfer conveyance belt 703. As the recording medium P passes through the transfer nip, the toner image is transferred onto the recording medium P, and then the recording medium P separated from the intermediate transfer belt 702 is delivered to a fixing device (not illustrated) by the secondary transfer conveyance belt 703.

According to the present embodiment, a first roller 704 disposed inside the loop formed by the intermediate transfer belt 702 may serve as a bias application roller to which a bias having the opposite polarity to the charge (normal charging polarity) on toner is applied. This is known as a repulsive force transfer method. Alternatively, a second roller 705 disposed inside the loop formed by the secondary transfer conveyance belt 703 opposite the first roller 704 may serves as a bias application roller to which a bias having the same polarity as the toner (normal charging polarity) is applied. This is known as an attraction transfer method.

Furthermore, a transfer bias roller and/or a bias application brush may be disposed inside the loop formed by the secondary transfer conveyance belt 703, and the transfer bias is applied to the transfer bias roller and/or the bias application brush. The transfer bias roller and/or the bias application brush may be disposed below the transfer nip or near the transfer nip but downstream from the transfer nip. The transfer roller (transfer bias roller) may include a foam layer (elastic layer) or a surface layer coated with elastic material such as foam. Alternatively, the transfer charger may be employed.

The configuration of the transfer portion is not limited to the configuration described above. The second roller side may be substituted by a belt member. The contact-free method using the charger may be employed. Any suitable power source such as a known power source may be employed as a power source for outputting the superimposed bias.

The configuration of the image forming apparatus is not limited to the configuration described above. The order of image forming units arranged in tandem is not limited to the above-described order. The present invention may be applied to an image forming apparatus using toners in three different colors or less.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system. For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearing member to hear a toner image charged with a predetermined polarity; and a power source to apply a bias to a transfer portion to transfer the toner image from the image bearing member to a recording medium, a polarity of the bias being changed alternately between a negative polarity and a positive polarity, wherein the toner image formed with toner of a plurality of colors is transferred in a color mode and the toner image formed with toner of a single color is transferred in a monochrome mode, the bias includes a peak voltage with a polarity that returns toner from the recording medium to the image bearing member, and an absolute value of the peak voltage in the color mode is equal to or greater than an absolute value of the peak voltage in the monochrome mode.

2. The image forming apparatus according to claim 1, wherein the bias is a superimposed transfer bias in which a alternating current (AC) component is superimposed on a direct current (DC) component, and wherein levels of both the DC component and the AC component are different between the color mode and the monochrome mode.

3. The image forming apparatus according to claim 2, wherein a peak-to-peak voltage of the AC component in the color mode is greater than the peak-to-peak voltage in the monochrome mode.

4. The image forming apparatus according to claim 2, wherein both the DC component and the AC component of the superimposed transfer bias are constant-voltage controlled.

5. The image forming apparatus according to claim 2, wherein the DC component of the superimposed transfer bias is constant-current controlled, and the AC component of the superimposed transfer bias is constant-voltage controlled.

6. The image forming apparatus according to claim 2, wherein the superimposed transfer bias is changed in accordance with a type of the recording medium.

7. The image forming apparatus according to claim 2, further comprising a selector to select any one mode of a plurality of modes that are different in an amount of toner per unit area of the toner image, wherein when changing the one mode selected with the selector to increase the amount of the toner per unit area of the toner image, a peak-to-peak voltage is set to increase.

8. The image forming apparatus according to claim 1, wherein an absolute value of a time average of the bias in the color mode is greater than an absolute value of the time average of the bias in the monochrome mode.

9. The image forming apparatus according to claim 1, further comprising a nip forming member to form a transfer nip between a surface of the image bearing member and the nip forming member, wherein the power source outputs the bias to transfer the toner image from the image bearing member to the recording medium.

10. The image forming apparatus according to claim 9, wherein the image bearing member is a belt, and wherein the image forming apparatus further comprises a back-face member disposed at a back-face side of the belt at the transfer nip.

11. An image forming apparatus, comprising:

an image bearing member to bear a toner image charged with a predetermined polarity; and a power source to apply a bias to a transfer portion to transfer the toner image from the image bearing member to a recording medium, a polarity of the bias being changed alternately between a negative polarity and a positive polarity, wherein the toner image formed with toner of a plurality of colors is transferred in a color mode and the toner image formed with toner of a single color is transferred in a monochrome mode, the bias alternately generates a transfer direction electric field that moves toner from the image bearing member to the recording medium and a return electric field that returns toner from the recording medium to the image bearing member, and a peak value of an intensity of the return electric field in the color mode is equal to or greater than a peak value of the intensity of the return electric field in the monochrome mode.

12. The image forming apparatus according to claim 11, wherein the bias is a superimposed transfer bias in which an alternating current (AC) component is superimposed on a direct current (DC) component, and wherein levels of both the DC component and the AC component are different between the color mode and the monochrome anode.

13. The image forming apparatus according to claim 12, wherein a peak-to-peak voltage of the AC component in the color mode is greater than the peak-to-peak voltage in the monochrome mode.

14. The image forming apparatus according to claim 12, wherein both the DC component and the AC component of the superimposed transfer bias are constant-voltage controlled.

15. The image forming apparatus according to claim 12, wherein the DC component of the superimposed transfer bias is constant-current controlled, and the AC component of the superimposed transfer bias is constant-voltage controlled.

16. The image forming apparatus according to claim 12, wherein the superimposed transfer bias is changed in accordance with a type of the recording medium.

17. The image forming apparatus according to claim 12, further comprising a selector to select any one mode of a plurality of modes that are different in an amount of toner per unit area of the toner image, wherein when changing the one mode selected with the selector to increase the amount of the toner per unit area of the toner image, a peak-to-peak voltage is set to increase.

18. The image forming apparatus according to claim 11, wherein an absolute value of a time average of the bias in the color mode is greater than an absolute value of the time average of the bias in the monochrome mode.

19. The image forming apparatus according to claim 11, further comprising a nip forming member to form a transfer nip between a surface of the image bearing member and the nip forming member, wherein the power source outputs the bias to transfer the toner image from the image bearing member to the recording medium.

20. The image forming apparatus according to claim 19, wherein the image bearing member is a belt, and wherein the image forming apparatus further comprises a back-face member disposed at a back-face side of the belt at the transfer nip.

21. An image forming apparatus, comprising:

an image bearing member to bear a toner image charged with a predetermined polarity; and a power source to apply a bias to a transfer portion to transfer the toner image from the image bearing member to a recording medium, a polarity of the bias being changed alternately, wherein the toner image formed with toner of a plurality of colors is transferred in a color mode and the toner image formed with toner of a single color is transferred in a monochrome mode, the bias includes a peak voltage with a polarity that returns toner from the recording medium to the image bearing member, an absolute value of the peak voltage in the color mode is equal to or greater than an absolute value of the peak voltage in the monochrome mode, the bias is a superimposed transfer bias in which an alternating current (AC) component is superimposed on a direct current (DC) component, and levels of both the DC component and the AC component are different between the color mode and the monochrome mode.

22. An image forming apparatus, comprising:

an image bearing member to bear a toner image charged with a predetermined polarity; and a power source to apply a bias to a transfer portion to transfer the toner image from the image bearing member to a recording medium, wherein the toner image formed with toner of a plurality of colors is transferred in a color mode and the toner image formed with toner of a single color is transferred in a monochrome mode, the bias alternately generates a transfer direction electric field that moves toner from the image bearing member to the recording medium and a return electric field that returns toner from the recording medium to the image bearing member, a peak value of an intensity of the return electric field in the color mode is equal to or greater than a peak value of the intensity of the return electric field in the monochrome mode, the bias is a superimposed transfer bias in which an alternating current (AC) component is superimposed on a direct current (DC) component, and levels of both the DC component and the AC component are different between the color mode and the monochrome mode.

* * * * *